US008935902B2

(12) United States Patent
Roth

(10) Patent No.: US 8,935,902 B2
(45) Date of Patent: Jan. 20, 2015

(54) GUIDE TRACK FOR CAPS

(75) Inventor: Emmanuel Roth, Octeville-sur-Mer (FR)

(73) Assignee: Sidel Participations, Octeville-sur-Mer (FR)

( * ) Notice: Subject to any disclaimer, the term of this patent is extended or adjusted under 35 U.S.C. 154(b) by 566 days.

(21) Appl. No.: 13/382,864

(22) PCT Filed: Jul. 2, 2010

(86) PCT No.: PCT/FR2010/051392

§ 371 (c)(1), (2), (4) Date: Jan. 6, 2012

(87) PCT Pub. No.: WO2011/004102

PCT Pub. Date: Jan. 13, 2011

(65) Prior Publication Data

US 2012/0110949 A1 May 10, 2012

(30) Foreign Application Priority Data

Jul. 7, 2009 (FR) ..... 09 54675

(51) Int. Cl.
*B67B 3/00* (2006.01)
*B67B 3/28* (2006.01)
*B67B 3/06* (2006.01)

(52) U.S. Cl.
CPC ..... *B67B 3/06* (2013.01)
USPC ..... 53/310; 53/306; 53/287

(58) Field of Classification Search
CPC ..... B67B 3/00; B65B 7/28
USPC ..... 53/310, 485, 490, 287, 306, 311, 312, 53/317, 367, 308
See application file for complete search history.

(56) References Cited

U.S. PATENT DOCUMENTS

| | | | | |
|---|---|---|---|---|
| 1,434,376 A | | 11/1922 | Dorman | |
| 2,005,585 A | * | 6/1935 | Kantor | 193/2 R |
| 2,501,291 A | * | 3/1950 | Rue | 53/141 |
| 2,551,477 A | | 5/1951 | Vore | |
| 2,667,999 A | | 2/1954 | Vore et al. | |
| 3,771,284 A | * | 11/1973 | Boeckmann et al. | 53/282 |
| 3,908,341 A | * | 9/1975 | Conti | 53/314 |
| 3,975,886 A | * | 8/1976 | Waters | 53/310 |

(Continued)

FOREIGN PATENT DOCUMENTS

| | | |
|---|---|---|
| DE | 433 699 | 9/1926 |
| DE | 38 43 374 A1 | 7/1990 |

OTHER PUBLICATIONS

French Preliminary Search Report for FR0954675, dated Mar. 12, 2010.

*Primary Examiner* — Gloria R Weeks
(74) *Attorney, Agent, or Firm* — Sughrue Mion, PLLC

(57) ABSTRACT

A guide track associated with a capping machine, including a capping head that is adjustable to fit the different formats of bottles. The track has, upstream from and adjacent to the capping head, a telescopic portion having a section rigidly connected to the capping head and movable with the latter, and a stationary section rigidly connected to a general frame. The telescopic portion of the guide track for caps includes side walls, the surface of which is smooth, regardless of the position of the stationary section and the movable section in relation to one another. The stationary section and the movable section are transversely shifted, and guided with regard to one another, by a runner system.

6 Claims, 3 Drawing Sheets

(56) References Cited

U.S. PATENT DOCUMENTS

Figure 1:
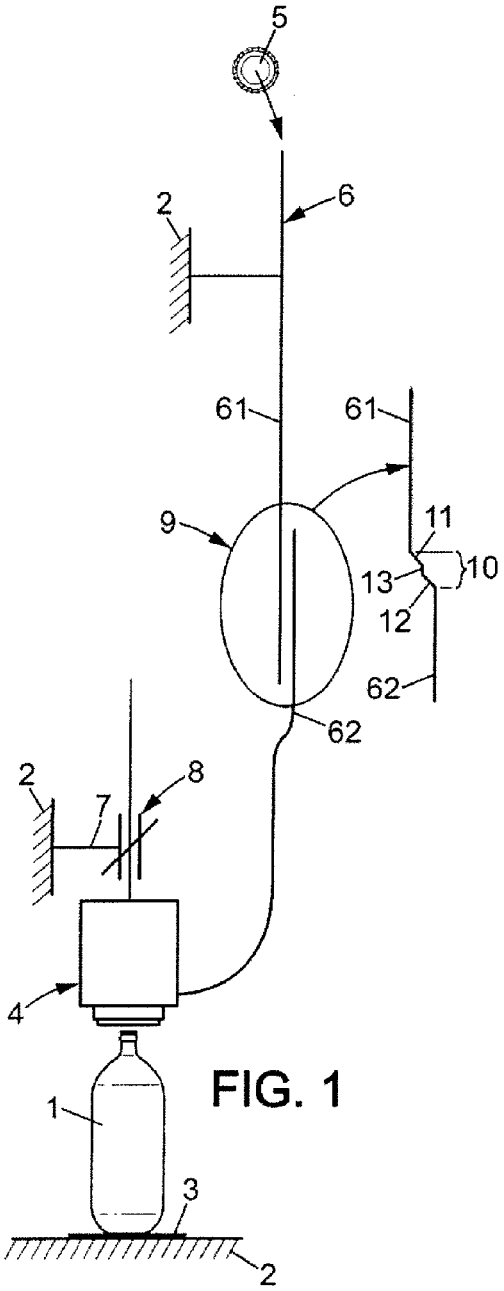

| | | | | | |
|---|---|---|---|---|---|
| 4,219,986 | A * | 9/1980 | Osterhaus | 53/314 |
| 4,250,685 | A * | 2/1981 | Elsworth | 53/282 |
| 4,548,020 | A * | 10/1985 | Rozmus et al. | 53/268 |
| 4,663,913 | A * | 5/1987 | Trendel | 53/314 |
| 4,885,894 | A * | 12/1989 | Herzog | 53/68 |
| 5,012,630 | A * | 5/1991 | Ingram et al. | 53/490 |
| 5,115,617 | A * | 5/1992 | Lewis et al. | 53/306 |
| 5,309,696 | A * | 5/1994 | Heudecker et al. | 53/306 |
| 5,398,480 | A * | 3/1995 | Bankuty | 53/315 |
| 6,115,992 | A * | 9/2000 | Bankuty et al. | 53/308 |
| 6,430,896 | B1 * | 8/2002 | Torikian | 53/310 |
| 6,453,641 | B1 * | 9/2002 | Puckett | 53/305 |
| 6,823,583 | B2 * | 11/2004 | Cirio | 29/785 |
| 6,971,216 | B2 * | 12/2005 | Monti | 53/310 |
| 7,040,075 | B2 * | 5/2006 | Seebeger et al. | 53/432 |
| 7,353,643 | B2 * | 4/2008 | Cirio | 53/290 |
| 7,415,816 | B2 * | 8/2008 | Bernhard | 53/490 |
| 7,503,154 | B2 * | 3/2009 | Monti | 53/306 |
| 7,536,839 | B2 * | 5/2009 | Kemper et al. | 53/426 |
| 7,997,048 | B2 * | 8/2011 | Bernhard | 53/253 |
| 8,413,408 | B2 * | 4/2013 | Bernhard | 53/253 |
| 2007/0006550 | A1 * | 1/2007 | Kemper et al. | 53/426 |
| 2007/0157552 | A1 * | 7/2007 | Cirio | 53/306 |
| 2007/0157563 | A1 * | 7/2007 | Ruppman et al. | 53/432 |
| 2010/0037557 | A1 * | 2/2010 | Wilhelm et al. | 53/331.5 |
| 2010/0064631 | A1 * | 3/2010 | Krauss et al. | 53/167 |
| 2011/0138740 | A1 * | 6/2011 | Evers | 53/167 |

* cited by examiner

GUIDE TRACK FOR CAPS

CROSS REFERENCE TO RELATED APPLICATIONS

This application is a National Stage of International Application No. PCT/FR2010/051392 filed Jul. 2, 2010, claiming priority based on French Patent Application No. 09 54675 filed Jul. 7, 2009, the contents of all of which are incorporated herein by reference in their entirety.

The invention relates to the field of bottle capping machines, and in particular to the guide track which feeds the capping head of said machine with capping items such as metal caps or so.

A capping head is generally fed, with metal caps for example, by means of a long guide track extending between the machine which sorts and orients the caps and said capping head. This long guide track has a vertical portion upstream from the capping head, which is in the form of a column known as a gravity chute.

With the improved production rate of such capping machines, it is possible to use them to process multiple series of bottles of different types, particularly when the bottle sizes, that is to say the bottle heights, can vary from series to series.

Such flexibility and versatility of the machines mean managing the vertical displacement of the capping head, and therefore an identical management of the movement of the downstream portion of the track in order to modify the dimension of the gravity chute.

The invention proposes an arrangement of this guide track for metal caps which allows the automatic adjustment of the length and height of the guide track for these caps and in particular the dimensions of the vertical portion of the gravity chute of the track which is positioned immediately upstream from the capping head, so as to establish a correspondence between this variation in the dimensions of said guide track and the variation in bottle size; thus one obtains an automatic adaptation of the guide track to the dimensions of the items to be capped.

The guide track is associated with a versatile capping machine comprising a vertically movable capping head; the cross-section of the track may be rectangular or some other shape. The track is arranged to allow the continuous circulation of items such as metal caps, and comprises a floor and a front or upper guide which are at a distance from each other that is substantially greater than the thickness of said caps, as well as side walls which are at a distance from each other that is substantially greater than the diameter corresponding to the size of said caps, with said track having a telescopic portion consisting of a section rigidly connected to said capping head and moving with said head, and a stationary section rigidly connected to the part of the track which feeds said metal caps, said telescopic portion thus automatically adjusting when the position of said capping head is adjusted subsequent to a change in the size of the bottles to be capped.

Still according to the invention, the telescopic portion of the guide track for the metal caps comprises side walls which have a smooth surface, i.e. continuous and uniform along the entire length of said telescopic portion, regardless of the position of the movable section relative to the stationary section.

In another arrangement of the invention, the two sections of the telescopic portion of the guide track—the stationary section and the movable section—are transversely offset, and are guided relative to each other by means of a runner system.

Still according to the invention, the continuity of the telescopic portion of the guide track between the two sections which can move relative to one another, is ensured by means of a baffle that is Z- or bayonet-shaped, shaped, said baffle comprising: —two portions which are arranged at an angle relative to the entry and exit tracks of the stationary and movable sections respectively, and—a portion which is parallel to said entry and exit tracks of said sections, said parallel portion being of a variable length which is adjusted according to the movement of the movable section of said track when there is a change in the size of the bottles to be capped.

In another arrangement of the invention, the extensible portion of the baffle is delimited by side walls consisting of a side wall which is part of the stationary section and a side wall which is part of the movable section.

Still according to the invention, the oblique upper wall (left edge) of the stationary section, corresponding to the entry into the baffle, extends above the floor of the movable section, to the side wall (left edge) of said movable section, to form a continuity between said walls delimiting this left edge, meaning that of said stationary section and said movable section.

In another arrangement of the invention, the oblique portions of the baffle form an angle with the variable length portion of this baffle, said angle being approximately 45°.

Still according to the invention, for the right edge, the front or upper guide of the stationary section extends over a part of the movable floor and over the corresponding right side wall of the movable section, and for the left edge, the front or upper guide of said movable section extends over the end of the left side wall of said stationary section so as to form, above said movable floor, a continuity of the surface guiding the caps as they pass from one section to the other.

In another arrangement of the invention, the stationary section acts as a cradle for the movable section. This cradle is U-shaped and comprises a bed and runner systems arranged in each of said sections.

Figure 2:
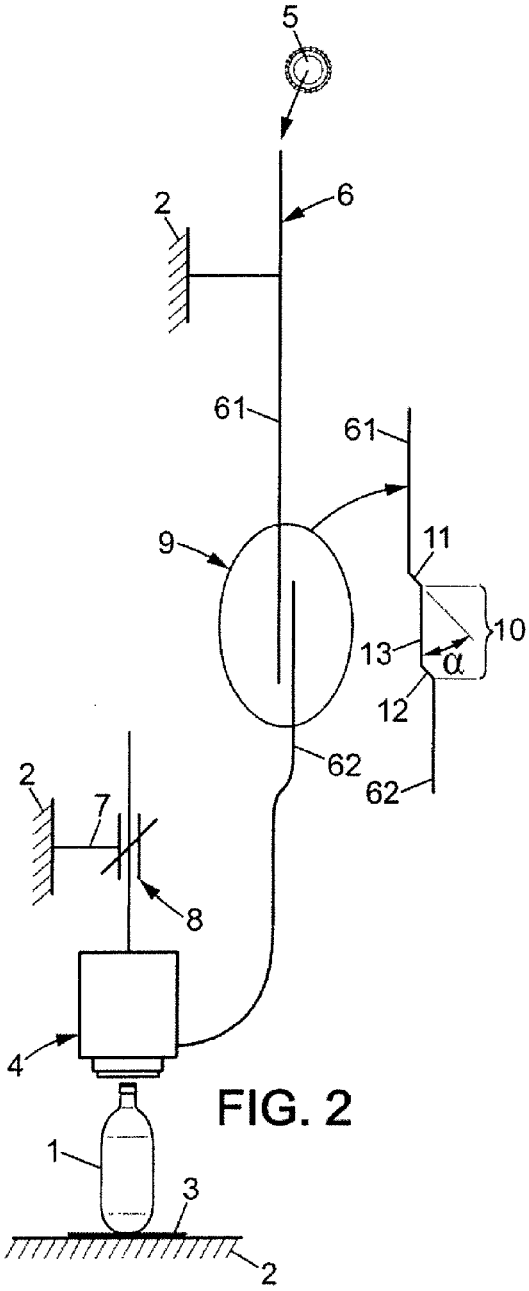
Figure 3:
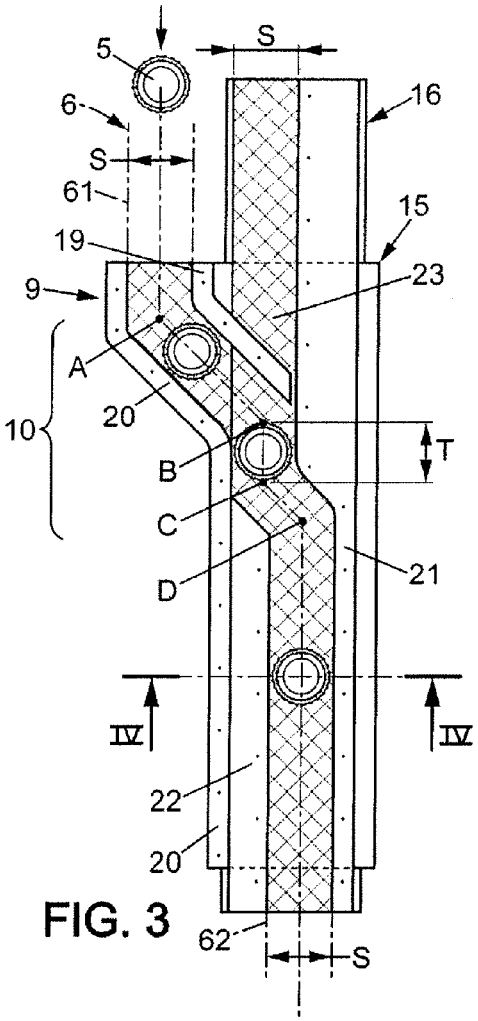
Figure 5:
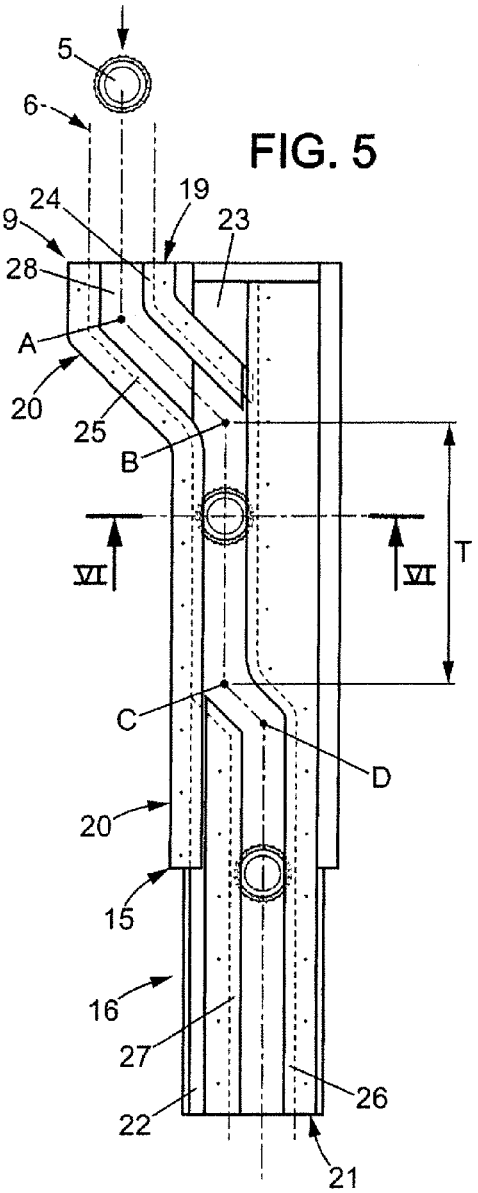
Figure 4:
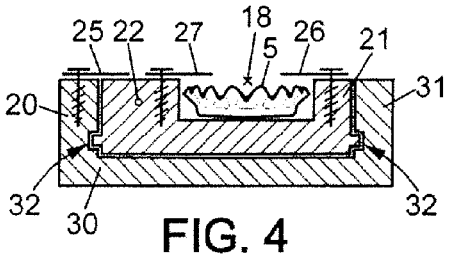
Figure 6:
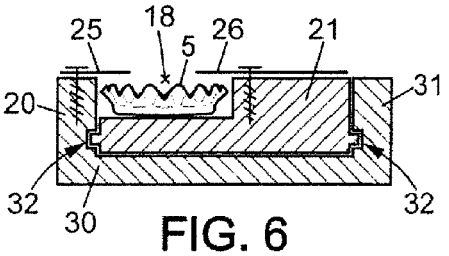
Figure 7:
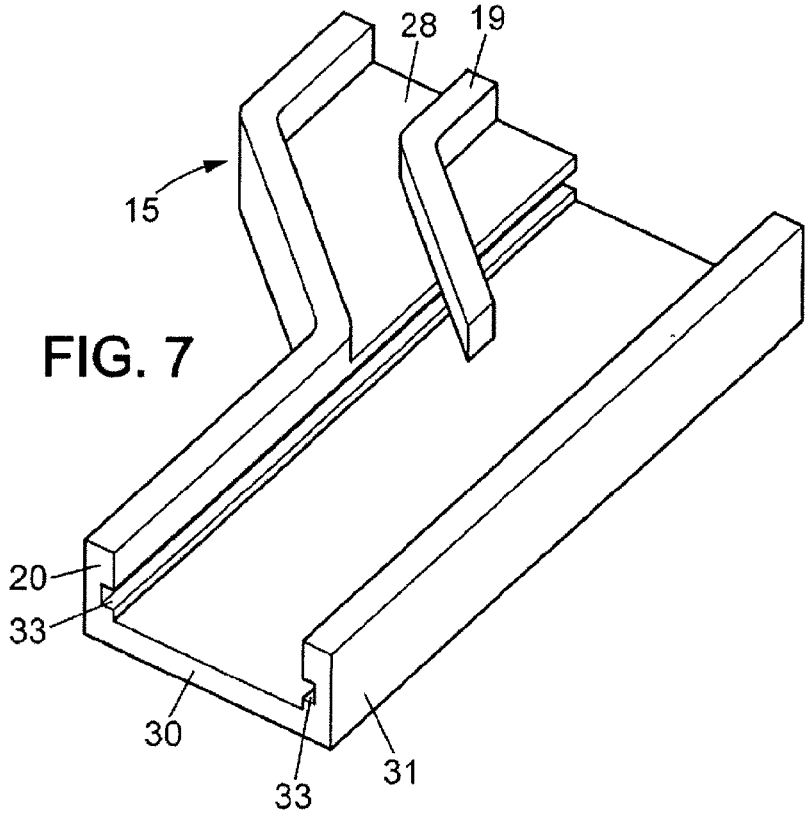
Figure 8:
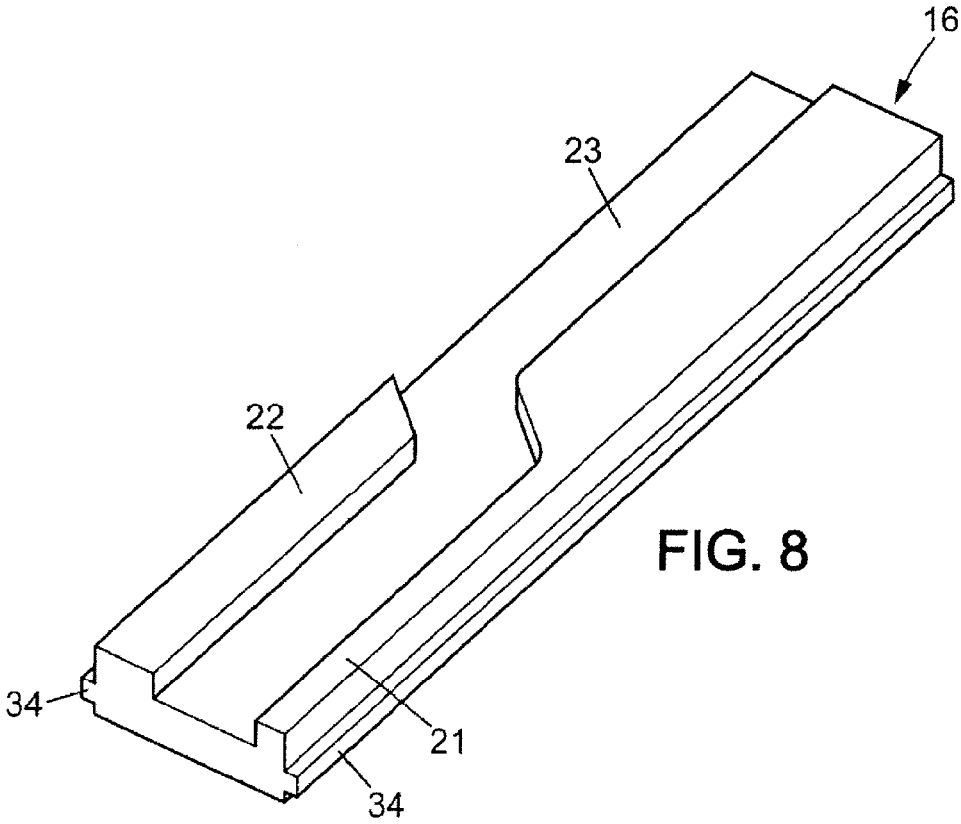

The invention is further detailed in the following description and the attached drawings, provided for illustrative purposes only, in which:

FIG. 1 shows the capping head of a machine with a telescopic track according to the invention, in which the track is adjusted for large bottles, FIG. 2 represents a capping head of a machine adjusted for small bottles, FIG. 3 shows a more detailed diagram of the telescopic portion of the guide track for caps when adjusted for large bottles; the telescopic portion is represented without the upper guides, FIG. 4 shows an enlarged cross-sectional view along IV-IV in FIG. 3, with the upper guides, FIG. 5 shows the telescopic portion of the guide track when adjusted for capping small bottles; the telescopic portion is represented with the upper guides, FIG. 6 shows an enlarged cross-sectional view along VI-VI in FIG. 5, FIG. 7 is a perspective view of the stationary section of the telescopic portion, without the upper guides, FIG. 8 is a perspective view of the movable section, without the upper guides.

FIGS. 1 and 2 schematically show the essential elements of a bottle capping machine 1; FIG. 1 illustrates a machine adjusted for large bottles 1 and FIG. 2 illustrates a machine adjusted for smaller bottles 1.

This capping machine has a general frame 2 equipped with a floor 3 which conveys the bottles 1. These bottles 1 are positioned under a capping head 4, said head 4 being vertically movable by appropriate means in order to adjust its position to the size of the bottles 1.

This capping head 4 is fed with capping items 5, particularly metal caps, by means of a track 6 in the form of a column having a rectangular or other cross-section. This track 6 consists, as detailed below, of a floor, front or upper guides, and opposing side walls, forming the left and right edges. This track 6 forms a gravity chute upstream from the capping head 4 and is supplied with caps from a cap sorting and orientation machine, not represented, generally referred to as the cap feeder.

This track comprises two parts: —an upper part 61 which is stationary, rigidly connected to the frame 2 of the machine or other, and—a lower part 62 which is rigidly connected to the capping head 4 and which is moved with this capping head 4 during adjustments.

The capping head 4 is vertically guided by means of a support 7 rigidly connected to the frame 2 and a runner system 8 which allows locking it in position. When it is vertically moved upwards or downwards during an adjustment, the capping head 4 shifts the movable portion 62 of the track 6 along with it.

This track 6 has a portion 9 which is telescopic, at the connection of the stationary portion 61 and the movable portion 62. This telescopic portion 9 absorbs the variations in the track 6 height resulting from the displacement of the capping head 4 during a change in the bottle 1 format.

As detailed in FIGS. 1 and 2, the telescopic portion 9 comprises a baffle 10 between the parts 61 and 62 of the track 6, which establishes the link between said parts 61 and 62. This baffle 10, which is in the shape of a Z or a double bayonet, is of interest for two reasons: it absorbs the size variations in the track 6 when the format of the bottles 1 is changed, and also decompresses the caps by forming a sort of pressure reducing valve. This pressure reduction in the column of caps 5 facilitates the movement of these caps 5 in the track 6, particularly in the lower part of this track which is connected to the capping head 4.

The baffle 10 comprises two track portions which are arranged at an oblique angle to the parts 61 and 62 which respectively form the cap entry and exit tracks for this baffle 10, and an intermediate track portion of variable length which is parallel to said parts 61 and 62.

In a more detailed description of FIGS. 1 and 2, the baffle 10 of the track 6 comprises: —an upper oblique portion 11 attached to the upper part 61 of said track 6, —a lower oblique portion 12 attached to the lower part 62 of said track 6, and—an intermediate portion 13 which is extensible and which is parallel to said upper stationary part 61 and to the movable lower part 62.

The two oblique portions 11 and 12 of the track are parallel to each other and form an angle a of approximately 45° with the extensible portion 13. These three portions 11, 12 and 13 form a Z in which the central segment is extensible. One can also say that this baffle 10 is bayonet-shaped, consisting of two juxtaposed bayonets having a common portion 13.

FIG. 3 shows a more detailed view of the telescopic portion 9 of the track 6 with this baffle 10. The track 6 is represented as dashed-and-dotted lines at each end of this telescopic portion 9.

This telescopic portion 9 consists of a section 15 which is stationary, rigidly connected for example to the frame 2, and a section 16 which is movable, guided relative to said section 15, said section 16 being rigidly connected to the capping head 4 by means of the portion 62 of the track 6.

The three portions of the baffle 10 described above in relation to FIGS. 1 and 2 are found again here in sections 15 and 16: —the oblique portion 11 delimited by A and B in FIG. 3, —the intermediate extensible portion 13 delimited by B and C, and—the oblique portion 12 delimited by C and D. These three portions are part of the continuity of parts 61 and 62 of the track 6.

The caps 5 travel in a channel 18, which can be seen in FIG. 4. This channel 18 has a rectangular cross-section for example, and its width is delimited by side walls. In the stationary section 15 (FIG. 3), this channel 18 is delimited by a wall 19 acting as the left edge and a wall 20 acting as the right edge. In the movable section 16, this channel 18 is delimited by a wall 21 which extends for the entire length of said section 16 and acts as a left edge, and by a wall 22 which acts as a right edge. This wall 22 only extends along the lower portion of the section 16, for a length which substantially corresponds to half the length of the section 16.

The wall 19 extends over the floor 23 of the section 16, for the entire width S of this floor. Said width corresponds to the distance separating the side walls forming the left edge and right edge, said distance substantially corresponding to the diameter of the metal caps 5.

FIG. 3 shows the telescopic portion 9 of the track 6 in a configuration which corresponds to the capping of large bottles 1, as described above for FIG. 1. One will note that the length T of the extensible portion 13, delimited by the points B and C, is relatively small. The length T could be near zero.

FIG. 5 shows the telescopic portion 9 in a configuration which corresponds to the filling of small bottles 1. The length T of the extensible portion 13 is automatically adjusted by the effect of the vertical displacement of the capping head 4.

One will note the presence in FIG. 5, as well as in FIGS. 4 and 6, of guides which close off the front part of the channel 18 in which the caps 5 are traveling. Each side wall supports a front or upper guide, attached by screws: —the wall 19 supports a guide 24, —the wall 20 supports a guide 25, the wall 21 supports a guide 26, and—the wall 22 supports a guide 27.

In the stationary section 15, the guide 25 extends over a portion, which is about a third, of the floor 28 and it also extends over the movable section 16: it extends over the telescopic portion of the floor 23 and over the wall 22 for a length which varies with the format of the bottles 1 to be capped.

In the movable section 16, the guide 26, which is attached to the wall 21, partially covers the floor 23 along its entire length and also covers the downstream end of the side wall 19 (left edge) which is part of the stationary section 15.

This arrangement provides the caps with a continuous and smooth surface for the entire length of the telescopic portion 9 of the track 6. The surface of the lateral guide walls forming the right and left edges of the track, together with the floor and the front guides, delimits a continuous passage for the caps 5. In fact, the breaks in continuity of these side walls occur in the narrow angles of the path traveled by the caps 5 and pose no risk of the caps catching or becoming stuck.

FIGS. 3 to 6 show that the section 15 is arranged to act as a cradle for the section 16. This section 15 comprises a bed 30 of a width corresponding to the width of the section 16, and this bed 30 has a side wing 31 extending up from it.

The assembly consisting of the bed 30, the wing 31, and the portion of the wall 20 which borders this section 16, forms a cradle having a U cross-section, said cradle comprising a system of lateral runners 32 which consist, for example, of grooves 33 in the section 15 and tongues 34 on the sides of the section 16, as illustrated in FIGS. 7 and 8.

FIG. 7 shows the stationary section 15 which acts as a cradle for the movable section 16 represented in FIG. 8. The stationary section 15 comprises, for example, lateral grooves 33, and the movable section 16 has tongues 34 on each side which cooperate with said grooves 33.

The section 16 can be guided relative to the section 15 by guiding means, for example rollers and rails. Said rollers can be installed on the back of said stationary section, on an appropriate base, so that they cooperate with vertical rails integrally attached to said movable section, with said rails being supported by a structure which allows them to float on the rollers on the back of said stationary section.

As detailed above, the arrangement of the side walls 19 and 20 of the section 15 and the walls 21 and 22 of the section 16 results in a continuity of these various walls, ensuring that the caps 5 are guided at their serrated peripheral edge.

These side walls present a uniform surface from the entry to the exit of this telescopic portion 9 of the track, meaning a smooth, regular, flat surface without holes, avoiding any risk of the metal caps 6 becoming caught or stuck.

The invention claimed is:

1. A guide track for a capping machine comprising a capping head for which the position is vertically adjustable to adapt to different formats of bottles, said track comprising a floor and front guides as well as side walls or edges which are at a distance from each other that is substantially greater than the diameter of said caps, said track comprising, upstream and adjacent to said capping head, a telescopic portion comprising a movable section rigidly connected to said capping head, and a stationary section rigidly connected to a general frame, said telescopic portion comprising a baffle that is Z- or bayonet-shaped and comprising two portions which are arranged at an angle relative to the entry and exit tracks of said stationary and movable sections respectively, and an intermediate portion which is parallel to the entry and exit tracks of said sections, said portion being extensible and its length being adjustable according to the displacement of said movable section when there is a change in the size of the bottles.

2. The guide track according to claim 1, wherein the extensible portion of the baffle is delimited by side walls comprising a side wall which is part of the stationary section and a side wall which is part of the movable section.

3. The guide track according to claim 2, wherein the upper oblique side wall of the stationary section, corresponding to the entry into the baffle, extends above the floor of the movable section, to the side wall of said movable section, to form a continuity between said walls which delimit the left edge.

4. The guide track according to claim 3, wherein the oblique portions of the baffle form an angle with the extensible portion of this baffle, said angle being approximately 45°.

5. The guide track according to claim 1, wherein, for the right edge, the front guide of the stationary section also extends over a part of the floor and of the right side wall of the movable section, and for the left edge, the front guide of said movable section extends over the end of the left side wall of said stationary section.

6. The guide track according to claim 1, wherein the stationary section acts as a cradle for the movable section, said cradle being U-shaped and comprising a bed and runners arranged in each of said sections.

* * * * *